US009170048B2

(12) United States Patent
Lochner et al.

(10) Patent No.: US 9,170,048 B2
(45) Date of Patent: Oct. 27, 2015

(54) DEVICE FOR THE CRYOGENIC SEPARATION OF AIR

(75) Inventors: Stefan Lochner, Grafing (DE); Kurt Huber, Munich (DE)

(73) Assignee: Linde Aktiengesellschaft, Munich (DE)

( * ) Notice: Subject to any disclaimer, the term of this patent is extended or adjusted under 35 U.S.C. 154(b) by 368 days.

(21) Appl. No.: 13/637,036

(22) PCT Filed: Mar. 25, 2011

(86) PCT No.: PCT/EP2011/001509

§ 371 (c)(1),
(2), (4) Date: Dec. 3, 2012

(87) PCT Pub. No.: WO2011/116981

PCT Pub. Date: Sep. 29, 2011

(65) Prior Publication Data

US 2013/0086942 A1 Apr. 11, 2013

(30) Foreign Application Priority Data

Mar. 26, 2010 (DE) ..... 10 2010 012 920
Mar. 1, 2011 (EP) ..... PCT/EP2011/001004

(51) Int. Cl.
*F25J 3/00* (2006.01)
*F25J 3/04* (2006.01)

(52) U.S. Cl.
CPC ..... *F25J 3/04187* (2013.01); *F25J 3/0489* (2013.01); *F25J 3/04412* (2013.01);
(Continued)

(58) Field of Classification Search
CPC ... F25J 3/04018; F25J 3/04024; F25J 3/0443; F25J 3/04454; F25J 3/04872; F25J 3/04878; F25J 3/0489; F25J 2290/40; F25J 2290/42; F25J 3/04666; F25J 3/04703; F25J 3/04709; F25J 3/04715; F25J 3/04945; F25J 3/04466; F25J 3/0295; F25J 3/04866
USPC ..... 62/643, 652
See application file for complete search history.

(56) References Cited

U.S. PATENT DOCUMENTS 3,750,413 A * 8/1973 Milligan et al. ..... 62/298
4,022,030 A 5/1977 Brugerolle
(Continued)

FOREIGN PATENT DOCUMENTS

DE 199 04 526 9/1999
DE 199 19 587 11/1999
(Continued)

OTHER PUBLICATIONS

"Air Separation Low Purity Oxygen Production," Research Disclosure, Mason Publications, Jan. 1, 1997, No. 393, pp. 63-65.
(Continued)

*Primary Examiner* — Frantz Jules
*Assistant Examiner* — Keith Raymond
(74) *Attorney, Agent, or Firm* — Millen, White, Zelano & Branigan, P.C.

(57) ABSTRACT

The device serves for the cryogenic separation of air. It comprises a main heat exchanger (6) and a distillation column system for nitrogen-oxygen separation (5) with a double column (5), which contains a high-pressure column and a low-pressure column. The device also includes a mixing column (1) and means for introducing charge air via the main heat exchanger (6) into the high-pressure column and into the mixing column. A liquid oxygen line serves for introducing liquid oxygen from the low-pressure column into the upper region of the mixing column (1), an oxygen product line serves for extracting oxygen gas from the upper region of the mixing column (1) through the main heat exchanger (6). The mixing column (1) and the double column (5) are arranged in a common cold box (3). The mixing column (1) is attached to the double column (5) by way of connecting elements (10, 11).

17 Claims, 2 Drawing Sheets

Figure 1:
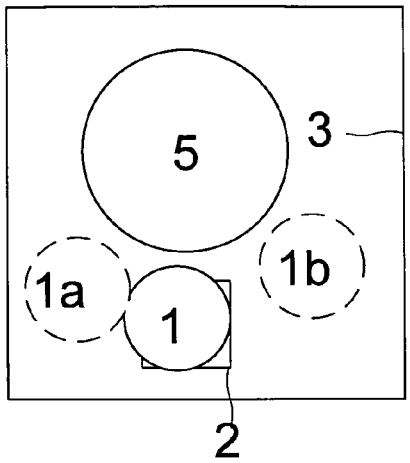

(52) U.S. Cl.
CPC ..... *F25J3/04418* (2013.01); *F25J 3/04466* (2013.01); *F25J 3/04872* (2013.01); *F25J 3/04945* (2013.01); *F25J 2200/04* (2013.01); *F25J 2290/40* (2013.01); *F25J 2290/42* (2013.01)

(56) References Cited

U.S. PATENT DOCUMENTS

| | | | | |
|---|---|---|---|---|
| 5,205,042 | A * | 4/1993 | Greter et al. | 33/365 |
| 5,454,227 | A | 10/1995 | Straub et al. | |
| 5,490,391 | A | 2/1996 | Hogg et al. | |
| 5,715,706 | A * | 2/1998 | Rathbone | 62/646 |
| 6,134,915 | A | 10/2000 | Denzau et al. | |
| 6,148,637 | A | 11/2000 | Guillard et al. | |
| 6,167,723 | B1 | 1/2001 | Guillard | |
| 6,182,470 | B1 * | 2/2001 | Guillard | 62/646 |
| 6,662,594 | B2 * | 12/2003 | Rampp et al. | 62/643 |
| 6,662,595 | B2 | 12/2003 | Corduan et al. | |
| 6,776,004 | B2 | 8/2004 | Rottmann et al. | |
| 2001/0052244 | A1 | 12/2001 | Rottmann et al. | |
| 2003/0110796 | A1 | 6/2003 | Rampp et al. | |
| 2004/0000166 | A1 * | 1/2004 | Moeller et al. | 62/643 |
| 2006/0260357 | A1 * | 11/2006 | Gibbon | 62/643 |
| 2007/0199344 | A1 | 8/2007 | Howard | |
| 2010/0139318 | A1 | 6/2010 | Cavagne et al. | |

FOREIGN PATENT DOCUMENTS

| | | | |
|---|---|---|---|
| EP | 1 041 535 | | 10/2000 |
| EP | 1 319 912 | | 6/2003 |
| EP | 2030662 | A1 * | 3/2009 |
| WO | WO-2008 110732 | | 9/2008 |

OTHER PUBLICATIONS

International Search Report for PCT/EP2011/001004, Date of mailing of the international search report: Jul. 2, 2012, Date of the completion of the international search: Jun. 20, 2012.

International Search Report for PCT/EP2011/001509, Date of the actual completion of the international search: Jun. 21, 2012, Date of the mailing of the international search report: Jul. 2, 2012.

* cited by examiner

DEVICE FOR THE CRYOGENIC SEPARATION OF AIR

The invention relates to a device for low-temperature separation of air according to the preamble of claim 1.

Air separation methods with mixed columns have been known since the 1970s (DE 2204376 =U.S. Pat. No. 4,022,030). In addition, such methods are disclosed in U.S. Pat. No. 5,454,227, U.S. Pat. No. 5,490,391, DE 19803437 A1, DE 19951521 A1, EP 1139046 B1 (=US 2001052244 A1), EP 1284404 A1 (=U.S. Pat. No. 6,66,595 B2), DE 10209421 A1, DE 10217093 A1, EP 1376037 B1 (=U.S. Pat. No. 6,776,004 B2), EP 1387136 A1 and EP 1666824 A1. These documents show only schematic process diagrams and contain no information on the spatial arrangement of the mixed column relative to the other parts of the apparatus.

A coldbox is used for thermal insulation of system parts (see, for example, Hausen/Linde, Tieftemperaturtechnik [Low-Temperature Technology], 1985, in particular pages 490 and 491). A "coldbox" is defined here as an insulating jacket, which comprises a heat-insulated interior space complete with outer walls; system parts that are to be insulated, for example one or more separation columns and/or heat exchangers, are arranged in the interior space. The insulating action can be produced by corresponding configuration of the outer walls and/or by the filling of the intermediate space between system parts and outer walls with an insulating material. In the latter variants, preferably a powdery material, such as, for example, perlite, is used.

From DE 19904526 A1, it is known to arrange high-pressure columns, low-pressure columns and mixed columns beside one another on the base. In U.S. Pat. No. 6,167,723, it is also recommended to set up the mixed column on the base; here, the low-pressure column is arranged above the mixed column, and the high-pressure column stands next to it. Also, in DE 19919587 A1, the mixed column stands on the base; the double column that consists of the high-pressure column and the low-pressure column is constructed above the mixed column.

The object of the invention is to find an improved arrangement of the system parts of a mixed column.

This object is achieved in that the mixed column is fastened via connecting elements laterally to the double column. In principle, the mixed column can be attached to the high-pressure column and/or the low-pressure column; it is preferably connected exclusively to the low-pressure column.

By this fastening method—in contrast to the conventional arrangement of the mixed column on the base or on a frame standing on the base—it is possible to freely select the geodetic height, on which the mixed column is arranged. For this purpose, the transport of liquids in the system can be optimized. In many cases, it is possible to build in pumps with lower output or even to forego one or more pumps. This applies in particular at relatively low pressure in the mixed column or in the oxygen gas-product gas from the mixed column.

The connecting elements can be designed with any known technology, for example as profiles, pipes or a combination of such elements. They preferably consist of the same material as the column walls of mixed columns and double columns or of a similar material, and are connected, for example by welding, to these column walls. At the contact point between connecting elements and column walls, preferably plaster or reinforcement sheets are used, which consist of the same material as the column wall. The connecting elements preferably consist of metal profiles, which are also formed from the same material. If the shared coldbox is pre-fabricated at the plant and then is transported in complete form to the construction site, the connection design must in any case be strong enough to take up the forces resulting from the horizontal transport. If necessary, in addition a frame construction made of Cr-Ni steel can be attached to the plaster sheet, which reinforces the construction, but also creates a relatively large gap between the columns.

In principle, it is possible in this case to support the mixed column in addition from below, for example on another apparatus part that is arranged below the mixed column. Within the scope of the invention, the mixed column is preferably not supported from below, however, but rather in particular is connected to the double column exclusively by the connecting elements.

All data regarding spatial orientation relate here to the orientation of the device during the operation of the columns.

A container (for example, a column or a heat exchanger) is located "above" (or "below") another container when its lower edge (upper edge) is located on a higher (lower) geodetic level than the upper edge (lower edge) of the other container. In this case, a vertical line that goes through both containers can but should not exist. In the projection on a horizontal plane, the cross-sections of the two containers can overlap, but they can also be arranged completely offset to one another. The term "above one another"/"below one another" is defined analogously.

It is also possible to arrange the main heat exchanger in the shared coldbox so that the device overall has only a single coldbox. In this connection, however, the danger exists that the shared coldbox may exceed the allowable transport dimensions. In another configuration of the invention, the main heat exchanger is therefore arranged in another coldbox that is separate from the shared coldbox. The two coldboxes can be pre-fabricated in the shop and then transported separately from one another to the construction site.

In addition, the device can have a subcooling countercurrent device. The subcooling countercurrent device is used to subcool or to heat up one or more liquids from one of the columns of the distilling-column system for nitrogen-oxygen separation or the mixed column in the countercurrent to form one or more cold, gaseous streams, which in general come from the low-pressure column. In particular, in a subcooling countercurrent device, liquid streams that are depressurized at the boiling point from a column with higher pressure (for example, the high-pressure column) into a column with lower pressure (for example, the low-pressure column) are cooled as much as possible up to the boiling point, which corresponds to the lower pressure level. In this case, the amount of vapor (flash) during the depressurization from higher pressure to lower pressure is minimized. When the liquid oxygen is sent from the low-pressure column through the subcooling countercurrent device before injection into the mixed column, the liquid oxygen is conversely heated up to get as close as possible to the boiling point under the—usually higher—pressure of the mixed column. Counter to this, the cold streams are heated up to the dewpoint of the columns with the lower pressure. Since these streams go into the main heat exchanger, the process air in the high-pressure column is also hotter, i.e., it is nearer the dewpoint. The proportion of the preliquefied air is minimized.

The subcooling countercurrent device can be arranged in a system with two coldboxes in the additional coldbox.

As an alternative, the subcooling countercurrent device in the shared coldbox is arranged below the mixed column. In this case, the subcooling countercurrent device is preferably arranged below the mixed column and is also connected to the double column, in particular to the high-pressure column.

The connection to the double column is made by connecting elements very much like in the mixed column.

According to another configuration of the invention, the upper end of the mixed column is arranged at least at the height of the upper end of the double column or at most by one-fifth of the length of the double column below the upper end of the double column. Preferably, the mixed column is suspended as high as possible. Under certain conditions, it may even be useful to build the box higher than necessary for the double column to make possible the transport of the bottom liquid from the mixed column into the low-pressure column without a pump. The additional steel building costs can be outweighed in this case by the pump costs saved. This applies in particular for a method with injection of turbine air into the mixed column, as it is shown in, for example, U.S. Pat. No. 5,454,227 or U.S. Pat. No. 5,490,391, whereby the mixed column pressure is relatively low, in particular below the high-pressure column pressure. At higher mixed column pressures, (here, the turbine air in most cases is injected into the low-pressure column), the mixed column can also be arranged lower.

For example, the upper ends of the mixed column and the double column are located at the same geodetic height. Also, in the case of a relatively low mixed column pressure, a pump for transferring the bottom liquid from the mixed column into the low-pressure column can be eliminated by this relatively high position of the mixed column.

When the upper end of the mixed column is arranged above or below that of the upper end of the double column, the vertical gap between the upper end of the double column and the upper end of the mixed column is preferably approximately 0.4 m to 7.0 m.

Especially advantageous is an arrangement in which the mixed column is arranged in one corner of an imaginary rectangle 14, which is located in the horizontal, is oriented parallel to the walls of the shared coldbox, and in addition touches the outer walls of the mixed column and the double column. Relative to the outer walls of the shared coldbox, the imaginary rectangle has at least one insulation gap of 450 mm. As a result, the base area of the shared coldbox can be optimized. In this case, it is to be considered that the narrow side of the coldbox corresponds to the transport height, which must not exceed a maximum value in pre-fabricated coldboxes; the other side of the rectangle is the product thereof and should otherwise be as small as possible. For the case of assembly at the construction site, the mixed column is arranged in such a way that the coldbox volume is minimized.

Figure 2:
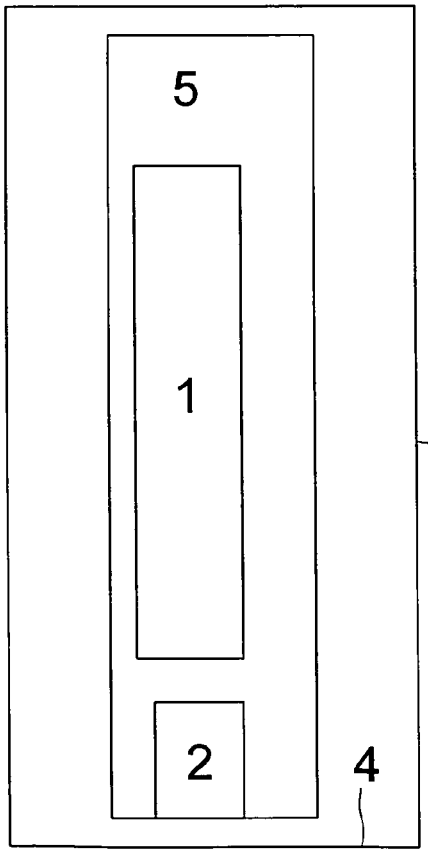
Figure 3:
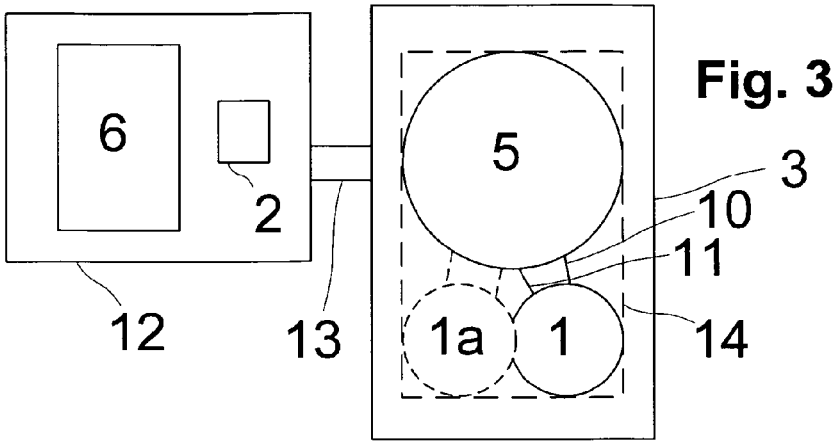
Figure 4:
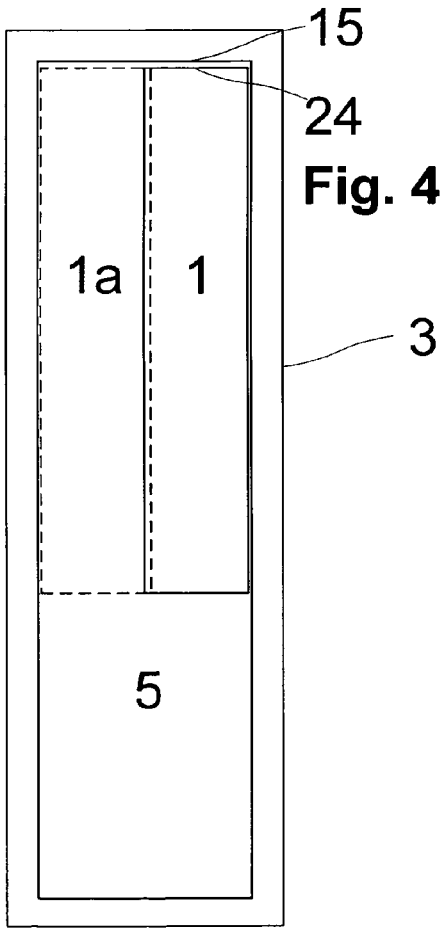

The invention as well as further details of the invention are explained in more detail below based on the embodiments that are diagrammatically depicted in the drawings. Here:

FIG. 1 shows a first embodiment of the invention with an arrangement of a mixed column and subcooling countercurrent device above one another in horizontal cross-section, FIG. 2 shows the first embodiment in vertical cross-section, FIG. 3 shows a second embodiment of the invention without a subcooling countercurrent device in the shared coldbox, and FIG. 4 shows the shared coldbox of the second embodiment in vertical cross-section.

In the example of FIG. 1, a mixed column 1 and a subcooling countercurrent device 2 are arranged in a shared coldbox 3. High-pressure columns and low-pressure columns of the distilling-column system for nitrogen-oxygen separation are produced as a conventional double column 5 and are also housed in the shared coldbox 3. FIG. 2 shows the same arrangement in another view.

In FIG. 1, only the outer side walls of the shared coldbox 3 are shown. Details such as pipelines, valves, and the interior of the devices 1, 2, 5, and 6 are not shown in the drawings. The intermediate space between the devices 1, 2, 5, and 6 and the outer wall of the shared coldbox 3 is filled with perlite. The bottom of the shared coldbox 3 is formed by a separate outer wall. The double column 5 is supported by a frame, not shown, on the base 4 of the shared coldbox 3. The mixed column 1 and the subcooling countercurrent device are supported by connecting elements on the double column 5, also not shown. These connecting elements are constructed the same or much like the connecting elements shown in FIG. 3.

A main heat exchanger is housed in the first embodiment in a separate additional coldbox (not shown in FIGS. 1 and 2).

The two dotted circles 1*a* and 1*b* in FIG. 1 represent two variations on the first embodiment, in which the mixed column is arranged offset to the subcooling countercurrent device 2. The mixed column, however, is also arranged here above the subcooling countercurrent device (analogously to FIG. 2).

Also in the example of FIG. 3, the mixed column 1 and the double column 5 are arranged in the shared coldbox 3. The subcooling countercurrent device 2 is, however, housed in another coldbox 12, together with the main heat exchanger 6. Also, here, details such as pipelines, valves, and the interior of the devices 1, 2, 5, and 6 are not shown. The main heat exchanger 6 is formed in the embodiment by a single heat exchanger block, in particular a plate heat exchanger. As an alternative, it can be formed by two or more blocks arranged horizontally beside one another and/or vertically above one another. As an alternative to the depiction in FIG. 3, the subcooling countercurrent device 2 can be arranged below the main heat exchanger 6.

FIG. 4 shows the same shared coldbox in another view.

The intermediate space between the devices 1, 2, and 5 and the outer wall of the shared coldbox 3 is filled with perlite. The bottom of the shared coldbox 3 is formed by a separate outer wall. The double column 5 is supported by a frame (standing frame), not shown, on the base 4 of the shared coldbox 3. The mixed column 1 is supported exclusively on the double column 5, specifically by, preferably by, in each case at least two connecting elements that are arranged in each case in the upper and lower areas of the mixed column 1 [sic]. The connecting elements are correspondingly dimensioned; optionally, more than two connecting elements can also be used. In the embodiment depicted, two pairs of connecting elements are used, which are arranged in each case in the upper and lower areas of the mixed column 1. The upper pair of these connecting elements 10, 11 is diagrammatically depicted in FIG. 3. Preferably, the upper element is designed as an attachment point (welded or screwed on both columns), but the lower element is designed as a guide bearing to compensate for temperature stresses. This guide bearing fixes the horizontal arrangement and makes possible a relative movement of mixed column and double column in the vertical direction.

The large dotted line 14 in FIG. 3 represents an imaginary rectangle, which has a purely geometric meaning, but does not correspond to any apparatus part. (Here, the space between the dotted line 14 and the outer wall 3 of the box marks the minimum insulation gap in which there should be no cold components). The imaginary rectangle 14 is located in the horizontal, is oriented parallel to the walls of the coldbox 3, and in addition rests on the outer walls of the two columns 1, 5. Within the scope of the invention, the mixed column 1 is preferably arranged in one corner of this rectangle 14, i.e., it touches at two points of the rectangle 14. (FIG. 4 does not show this aspect completely correctly, for reasons of drafting).

The fine dotted lines in FIGS. 3 and 4 represent a variation on the first embodiment, in which the mixed column la is arranged differently.

In the embodiment of FIGS. 3 and 4, the upper end 24 of the mixed column is arranged 0.4 m below the upper end 15 of the double column 5 with a total height of the double column of approximately 35 m.

The orientation of the two coldboxes to one another can be shown differently from the orientation in the drawings and can be selected as desired depending on the spatial boundary conditions.

The invention claimed is:

1. A device for low-temperature separation of air comprising:

a main heat exchanger (6), a distilling-column system for nitrogen-oxygen separation (5) comprising a double column (5), which contains a high-pressure column and a low-pressure column, and a mixed column (1), said distilling-column system having means for introducing charging air, via the main heat exchanger (6), into the high-pressure column and into the mixed column, a liquid oxygen line for introducing liquid oxygen from the low-pressure column into an upper area of the mixed column (1), and an oxygen product line for withdrawing oxygen gas from the upper area of the mixed column (1) via the main heat exchanger (6), wherein the mixed column (1) and the double column (5) are arranged in a shared coldbox (3), wherein the mixed column (1) is not supported from below, and wherein the mixed column (1) is fastened via connecting elements (10, 11) laterally to the double column (5).

2. The device according to claim 1, wherein the main heat exchanger (6) is arranged in another coldbox (12) that is separate from the shared coldbox (3).

3. The device according claim 2, further comprising a subcooling countercurrent device (2), which is arranged in the additional coldbox (12).

4. The device according to claim 1, further comprising a subcooling countercurrent device (2), which is arranged in the shared coldbox (3) below the mixed column (1).

5. The device according to claim 1, wherein the upper end (24) of the mixed column (1) is arranged at least at the height of the upper end (15) of the double column (5).

6. The device according to claim 1, wherein the upper end (24) of the mixed column (1) is arranged at most by one-fifth of the length of the double column (5) below the upper end of the double column (5).

7. The device according to claim 1, wherein said mixed column (1) is supported on said double column (5) by said connecting elements.

8. The device according to claim 4, wherein said mixed column (1) and said subcooling countercurrent device (2) are supported on said double column (5) by said connecting elements.

9. The device according to claim 1, wherein said mixed column (1) is fastened via said connecting elements to said high-pressure column of said double column (5).

10. The device according to claim 1, wherein said mixed column (1) is fastened via said connecting elements to said low-pressure column of said double column (5).

11. The device according to claim 1, wherein said mixed column (1) is fastened via said connecting elements exclusively to said low-pressure column of said double column (5).

12. The device according to claim 7, wherein said mixed column (1) is fastened via said connecting elements exclusively to said low-pressure column of said double column (5).

13. The device according to claim 1, wherein the upper ends of said mixed column and said double column are located at the same geodetic height.

14. The device according to claim 1, wherein the vertical gap between the upper end of said double column and said upper end of mixed column is 0.4 m to 7.0 m.

15. The device according to claim 1, wherein said connecting elements are made of the same material as the column walls of said mixed column and said double column.

16. The device according to claim 1, wherein said mixed column is supported exclusively on said double column by two pairs of said connecting elements and one pair of said connecting elements is arranged in the upper area of said mixed column and the other pair of said connecting elements is arranged in the lower area of said mixed column, and said pair of said connecting elements arranged in the upper area of said mixed column are attached to both said mixed column and said double column, and the other pair of said connecting elements arranged in the lower area of said mixed column are guide bearings which make possible a relative movement of said mixed column and said double column in the vertical direction.

17. A device for low-temperature separation of air comprising:

a main heat exchanger (6);

a distilling-column system for nitrogen-oxygen separation (5) comprising double column (5), wherein said double column (5) contains a high-pressure column and a low-pressure column, and a mixed column (1), a charging air line for introducing charging air into the high-pressure column and into the mixed column of the distilling-column system via the main heat exchanger (6), a liquid oxygen line for introducing liquid oxygen from the low-pressure column into an upper area of the mixed column (1), and an oxygen product line for withdrawing oxygen gas from the upper area of the mixed column (1) via the main heat exchanger (6), wherein the mixed column (1) and the double column (5) are arranged in a shared coldbox (3), wherein the mixed column (1) is not supported from below, and wherein the mixed column (1) is fastened via connecting elements (10, 11) laterally to the double column (5).

* * * * *